US011674114B2

(12) United States Patent
Piorkowski

(10) Patent No.: US 11,674,114 B2
(45) Date of Patent: Jun. 13, 2023

(54) METHOD OF MAKING AN OPACIFIED LIQUID DETERGENT COMPOSITION USING A DIVALENT CATION SOLUTION

(71) Applicant: Henkel AG & Co. KGaA, Duesseldorf (DE)

(72) Inventor: Daniel Thomas Piorkowski, Fairfield, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 237 days.

(21) Appl. No.: 16/949,428

(22) Filed: Oct. 29, 2020

(65) Prior Publication Data

US 2022/0135911 A1 May 5, 2022

(51) Int. Cl.

| | |
|---|---|
| ***C11D 1/29*** | (2006.01) |
| ***C11D 10/04*** | (2006.01) |
| ***C11D 9/00*** | (2006.01) |
| ***C11D 17/00*** | (2006.01) |
| ***C11D 1/83*** | (2006.01) |
| *C11D 1/74* | (2006.01) |
| *C11D 1/22* | (2006.01) |

(52) U.S. Cl.

CPC ..... *C11D 10/045* (2013.01); *C11D 1/83* (2013.01); *C11D 9/002* (2013.01); *C11D 17/003* (2013.01); *C11D 1/22* (2013.01); *C11D 1/74* (2013.01)

(58) Field of Classification Search

CPC .... C11D 1/22; C11D 1/29; C11D 1/04; C11D 1/37; C11D 1/66; C11D 1/83; C11D 3/02; C11D 3/1213; C11D 7/265

See application file for complete search history.

(56) References Cited

U.S. PATENT DOCUMENTS

| | | | | |
|---|---|---|---|---|
| 3,658,552 | A | 4/1972 | Carlson et al. | |
| 5,269,960 | A | 12/1993 | Gray et al. | |
| 5,417,878 | A * | 5/1995 | Takahata | C11D 17/006 510/447 |
| 5,747,440 | A * | 5/1998 | Kellett | C08G 73/024 510/501 |
| 5,919,749 | A * | 7/1999 | Sakamoto | C11D 1/65 510/501 |
| 5,990,066 | A | 11/1999 | Gordon et al. | |
| 6,462,004 | B2 * | 10/2002 | Farrell | C11D 3/1233 510/156 |
| 6,855,680 | B2 | 2/2005 | Smerznak et al. | |
| 7,179,780 | B2 * | 2/2007 | Forth | C11D 3/38663 510/393 |
| 8,901,062 | B2 | 12/2014 | D Meirleir et al. | |
| 9,023,786 | B2 | 5/2015 | Schmiedel et al. | |
| 2013/0310296 | A1 * | 11/2013 | Lizop | A61K 8/19 510/152 |
| 2015/0210957 | A1 | 7/2015 | Napolitano | |
| 2015/0376550 | A1 * | 12/2015 | Ohtani | C11D 3/505 510/319 |
| 2017/0015951 | A1 * | 1/2017 | Johnson | C11D 3/42 |
| 2021/0230508 | A1 * | 7/2021 | Wildemuth | C11D 11/0017 |

FOREIGN PATENT DOCUMENTS

| | | | |
|---|---|---|---|
| EP | 3517596 | * | 7/2019 |
| EP | 3517596 | A1 | 7/2019 |
| WO | 9533025 | A1 | 12/1995 |

OTHER PUBLICATIONS

PCT International Search Report PCT/US2021/057112 Completed: Feb. 17, 2022; dated Feb. 18, 2022 3 pages.

* cited by examiner

*Primary Examiner* — Charles I Boyer
(74) *Attorney, Agent, or Firm* — Bojuan Deng

(57) ABSTRACT

A method of making an opacified liquid detergent composition is disclosed. The method includes the steps of combining at least one anionic surfactant, a fatty acid, and water to form a mixture having a transparent optical appearance, then adding divalent cations to the mixture, and opacifying the mixture as the divalent cations interact with the fatty acid to form the opacified liquid detergent composition in the absence of a microplastic opacifier. The opacified liquid detergent composition having a turbidity value of greater than about 250 turbidity units (NTUs) measured utilizing a turbidity meter at about 24° C.

14 Claims, No Drawings

METHOD OF MAKING AN OPACIFIED LIQUID DETERGENT COMPOSITION USING A DIVALENT CATION SOLUTION

FIELD OF THE INVENTION

The present disclosure relates generally to liquid detergent compositions and, more particularly, to a method of making an opacified liquid detergent composition that in the absence of a microplastic opacifier.

BACKGROUND OF THE INVENTION

Liquid detergent compositions including laundry and dishwasher liquid detergents often utilize opacifiers to enhance the aesthetic and/or textural appearance of the liquid detergent. For example, many liquid detergents include ACUSOL™ OP301, a microplastic opacifier available from The Dow Chemical Company to provide a "milky" or "lotionized" appearance to the liquid detergent. Although suitable for their intended use, microplastic opacifiers do not degrade well.

Opacified liquid detergent compositions have been made to include biodegradable components. However, achieving suitable opacification of the liquid detergent composition has been a challenge.

BRIEF SUMMARY OF THE INVENTION

The present disclosure provides a method of making an opacified liquid detergent composition. The method includes the steps of: combining at least one anionic surfactant, a fatty acid, and water to form a mixture having a transparent optical appearance; then adding divalent cations to the mixture; and opacifying the mixture as the divalent cations interact with the fatty acid to form the opacified liquid detergent composition in the absence of a microplastic opacifier, the opacified liquid detergent composition having a turbidity value of greater than about 250 turbidity units (NTUs) measured utilizing a turbidity meter at about 24° C.

DETAILED DESCRIPTION OF THE INVENTION

The following detailed description is merely exemplary in nature and is not intended to limit the method of making the opacified liquid detergent composition of the present disclosure. Furthermore, there is no intention to be bound by any theory presented in the preceding background or the following detailed description.

The method described in detail below is used to make, form, and/or manufacture a liquid detergent composition that has been suitably opacified. This liquid detergent composition is referred to hereinbelow as an opacified liquid detergent composition. As used herein, the term "detergent" refers to a substance, preparation, agent, and/or the like including a mixture of ingredients having cleansing properties. One example is a laundry detergent, which is a detergent formulated for washing or cleaning laundry. Another example is dishwashing detergent, which is a detergent formulated for washing or cleaning dishware, drinking glasses, eating or cooking utensils, etc. The detergent may be specifically formulated for use in washing and cleaning processes performed with a washing machine or for use in washing or cleaning processes performed by hand.

Additionally, the term "opacified liquid detergent composition" refers to a liquid detergent composition that is opaque. The opacified liquid detergent composition may have any level of opaqueness, including a slightly opaque or translucent appearance in which some (but not all) light can be transmitted through the liquid such that objects behind the liquid cannot be seen clearly, an extremely opaque appearance in which no light can be transmitted through the liquid such that no objects behind the liquid can be seen clearly, and any level of opaqueness in-between. In an embodiment, the liquid detergent composition is considered suitably opacified when the liquid detergent composition has a turbidity value of greater than about 250 turbidity units (NTUs) measured utilizing a turbidity meter (such as a 2100N Laboratory Turbidimeter available from Hach Company (Loveland, Colo.)) at 24° C. At this turbidity, the liquid detergent composition is considered to be opacified, i.e., having a cloudy, milky, or lotionized appearance. In another embodiment, the liquid detergent composition of the present disclosure has a turbidity value of at least 2000 NTUs measured using the turbidity meter at 24° C. In a particular embodiment, the liquid detergent composition has a turbidity value of from about 2000 to about 3000 NTUs measured using the turbidity meter at 24° C. Additionally, the opacified liquid detergent composition is not transparent, where light can be transmitted through the liquid such that objects behind the liquid can be clearly seen.

The method of making the opacified liquid detergent composition includes the step of combining at least one anionic surfactant, a fatty acid, and water (such as deionized water) to form a mixture having a transparent optical appearance. As used herein, the term "transparent optical appearance" refers to an optical appearance enabling light to be transmitted through the mixture such that objects behind the mixture can be clearly seen by visual inspection. The at least one anionic surfactant, the fatty acid, and the water may be combined utilizing any suitable combining technique. In an embodiment, the combining step is performed by batch mixing, as referred to as batching. Batch mixing involves adding the at least one anionic surfactant, the fatty acid, and the water to a suitable batch mixer, and then mixing the components together at any suitable mixing speed, pressure, and/or duration. Typically, the components are added simultaneously. Alternatively, the components may be added sequentially and in any desirable order.

Any one or more anionic surfactants may be used. In an embodiment, the at least one anionic surfactant is a linear alkylbenzene sulfonate (LAS). The linear alkylbenzene sulfonate is a water-soluble salt of a linear alkyl benzene sulfonate having from 8 to 22 carbon atoms of the linear alkyl group. The salt may be an alkali metal salt or an ammonium, alkylammonium, alkanolammonium salt. In an example, the linear alkylbenzene sulfonate includes an alkali metal salt of $C_{10}$-$C_{16}$ alkyl benzene sulfonic acids, such as $C_{11}$-$C_{14}$ alkyl benzene sulfonic acids. Suitable linear alkylbenzene sulfonates include sodium and potassium linear, alkylbenzene sulfonates with the average number of carbon atoms in the alkyl group being from 11 to 14. In one example, sodium $C_{11}$-$C_{14}$ linear alkylbenzene sulfonate is a suitable anionic surfactant for the structured liquid detergent composition. It should be appreciated that, in certain embodiments, the at least one anionic surfactant could include one or more other anionic surfactants in addition to the linear alkylbenzene sulfonate.

In an embodiment, the method further includes adding at least one nonionic surfactant to the mixture. The step of adding the at least one nonionic surfactant may occur simultaneously with the step of adding the at least one anionic surfactant, the fatty acid, and the water to form the mixture. Alternatively, the nonionic surfactant(s) may be added subsequent to the step of combining the anionic surfactant(s), the fatty acid, and the water.

The anionic surfactant may be an alcohol ethoxy sulfate having the general Formula (1):

$$R_1—O—(C_2H_4O)_n—S_3M \quad (1),$$

where $R_1$ is an alkyl group having from 8 to 22 carbon atoms, n is an integer from 1 to 20, and M is a salt-forming cation. In an embodiment, $R_1$ is an alkyl group having from 5 to 20 carbon atoms, n is an integer from 1 to 16, and M is sodium, potassium ammonium, alkylammonium, or alkanolammonium. In a particular embodiment, $R_1$ is an alkyl group having from 8 to 20 carbon atoms, n is an integer from 1 to 10, and M is sodium, potassium ammonium, alkylammonium, or alkanolammonium. In other words, the alcohol ethoxy sulfate has a backbone including from 8 to 20 carbon atoms and is ethoxylated with from 1 to 10 moles of ethylene oxide. It should be appreciated that a single alcohol ethoxy sulfate or more than one alcohol ethoxy sulfate may be used.

In certain embodiments, one or more other nonionic surfactants may be used. Non-limiting examples of nonionic surfactants that may suitably be used include alkoxylated alcohols, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, alkylamine oxides, and combinations thereof.

The method may also include the step of adding one or more other surfactants such as, but not limited to, cationic surfactants, amphoteric (zwitterionic) surfactants, etc., to the mixture. The other surfactant(s) may be added simultaneous with the anionic surfactant(s), the fatty acid, and the water. Alternatively, the mixture of anionic surfactant(s), the fatty acid, and the water may be formed, and then the other surfactant(s) may be added to the mixture.

The fatty acid may be one having the Formula (2):

$$R_2—C(O)OH \quad (2)$$

where $R_2$ is a linear or branched aliphatic group having from 5 to 21 carbons atoms. In another embodiment, $R_2$ of Formula (2) above is a linear or branched aliphatic group having from 12 to 20 carbons atoms. In a particular embodiment, the fatty acid is obtained from palm kernel oil and has a backbone including from 12 to 20 carbon atoms. Such a fatty acid is dodecanoic acid, or may be referred to as coconut fatty acid. Alternatively, the fatty acid could be another suitable fatty acid, non-limiting examples including carboxylic acid, lauric acid, myristic acid, palmitic acid, stearic acid, topped palm kernel fatty acid, and combinations thereof.

In an embodiment, the method includes the step of adding colloidal particles to the mixture. The step of adding the colloidal particles may occur simultaneously with the step of adding the at least one anionic surfactant, the fatty acid, and the water to form the mixture. Alternatively, the colloidal particles may be added subsequent to the step of combining the anionic surfactant(s), the fatty acid, and the water.

In a non-limiting example, the colloidal particles are one or more encapsulated fragrances. Encapsulated fragrances are desirable in liquid detergent compositions, because encapsulated fragrances tend to keep laundered textiles fragrant for longer periods of time compared to unencapsulated fragrances or oils. Due, at least in part, to its lower density compared to the liquid detergent composition, it is typically challenging to suspend encapsulated fragrances in the liquid components of the liquid detergent composition in the absence of a structurant. As described in further detail below, crystals formed by the combination of the divalent cations and at least the fatty acid operate as a suitable structurant enabling colloidal particles, such as encapsulated fragrances, to be suitably suspended in the liquid components of the liquid detergent composition. In an embodiment, the colloidal particles have an effective particle size of from about 0.1 to about 500 μm and a density of from about 0.8 to about 1.25 g/mL.

In an embodiment, the method further includes adding at least one non-aqueous solvent to the mixture. Non-limiting examples of the non-aqueous solvent include ethanol, propylene glycol, butylene glycol, pentylene glycol, hexylene glycol, heptylene glycol, octylene glycol, diethylene glycol, triethylene glycol, 2-methyl-1,3-propanediol, glycerol, 1,3-propanediol, triacetin, ethyl acetate, benzyl alcohol, polyethylene glycol having a molecular weight of from 200 to 3000 g/mol, and combinations thereof. In one particular embodiment, the method includes adding glycerol and propylene glycol, as non-aqueous solvents, to the mixture.

The method may further include the step of adding one or more additives to the mixture. The additives may be added simultaneous with the anionic surfactant(s), the fatty acid, and the water to form the mixture. Alternatively, the mixture of anionic surfactant(s), the fatty acid, and the water may be formed, and then the additives may be added to the mixture. Non-limiting examples of additives include polymers (such as suspension polymers, stain removal polymers, etc.), neutralizing agents, optical brighteners, enzymes, colorants, chelators, and/or other additives.

A non-limiting example of a polymer that may be used as an additive for the composition is an alkoxylated polyethyleneimine. The alkoxylated polethyleneimine may have a polyethyleneimine backbone having a weight average molecular weight from about 300 to about 10,000. The polyethyleneimine backbone may be modified by either (1) one or two alkoxylation modifications per nitrogen atom depending, at least in part, on whether the modification occurs at an internal nitrogen atom or at a terminal nitrogen atom, in the polyethyleneimine backbone, the alkoxylation modification including the replacement of a hydrogen atom by a polyalkoxylene chain having an average of about 1 to about 40 alkoxy moieties per modification with the terminal alkoxy moiety of the alkoxylation modification capped with hydrogen, a $C_1$-$C_4$ alkyl, or combinations thereof, (2) a substitution of one $C_1$-$C_4$ alkyl moiety and one or two alkoxylation modifications per nitrogen atom depending, at least in part, on whether the substitution occurs at an internal nitrogen atom or at an terminal nitrogen atom, in the polyethyleneimine backbone, the alkoxylation modification including the replacement of a hydrogen atom by a polyalkoxylene chain having an average of about 1 to about 40 alkoxy moieties per modification with the terminal alkoxy moiety capped with hydrogen, a $C_1$-$C_4$ alkyl, or combinations thereof, or (3) a combination of (1) and (2).

The alkoxylation modification of the polyethyleneimine backbone includes the replacement of a hydrogen atom by a polyalkoxylene chain having an average of about 1 to about 40 alkoxy moieties, typically from about 5 to about 20 alkoxy moieties. The alkoxy moieties are selected from ethoxy (EO), 1,2-propoxy (1,2-PO), 1,3-propoxy (1,3-PO), butoxy (BO), and combinations thereof. In some embodiments, the polyalkoxylene chain is selected from ethoxy moieties and ethoxy/propoxy block moieties. The polyalkoxylene chain may be ethoxy moieties in an average degree of from about 5 to about 15 or the polyalkoxylene chain may be ethoxy/propoxy block moieties having an average degree of ethoxylation from about 5 to about 15 and an average degree of propoxylation from about 1 to about 16.

Non-limiting examples of suitable neutralizing agents include alkanolamines, hydroxides, and combinations thereof. In an embodiment, the alkanolamine is chosen from monoethanolamine (MEA), diethanolamine, triethanolamine, isopropanolamine, and/or the like. In another embodiment, the hydroxide is chosen from sodium hydroxide, potassium hydroxide, ammonium hydroxide, calcium hydroxide, and/or the like.

Suitable optical brighteners include, but are not limited to, stilbenes, distyrylbiphenyl derivatives, stilbene/naphthotriazole blends, oxazole derivatives, and/or coumarin brighteners.

The enzymes may be chosen from amylolytic, proteolytic, cellulolytic, and/or lipolytic-type enzymes. Other suitable enzymes include, but are not limited to, proteases, amylases, lipases, and cellulases such as bacterial proteases and protein-engineered variants thereof, fungal lipases and protein-engineered variants thereof, bacterial amylases, fungal enzymes, monocomponent cellulases, and/or the like. Blends of two or more enzymes may also be used, such as a protease/lipase blend, a protease/amylase blend, a protease/amylase/lipase blend, etc.

Suitable colorants include, but are not limited to, dyes of a variety of different colors, such as blue, yellow, green, orange, green, purple, etc. Suitable dyes include, but are not limited to, chromophore types such as azo, anthraquinone, triarylmethane, methine quinophthalone, azine, oxazine, and thiazine which may be of any desired color, hue or shade.

Chelators are used for removing undissolved minerals from the liquid detergent composition to reduce discoloration of the textiles caused by the minerals. Non-limiting examples of suitable chelators include tetrasodium iminodisuccinate (IDS), citric acid, ethylenediaminetetraacetic acid (EDTA) and derivative thereof, and diethylenetriaminepentaacetic acid and derivatives thereof.

Other additives include bittering agents (such as denatonium benzoate, aloin, and/or the like), oxygen scavengers (such as sodium sulfite), antifoaming agents (such as a polyalkoxylated alkanolamide, amide, amine oxide, betaine, sultaine, $C_8$-$C_{18}$ fatty alcohols, those derived from phenylpropylmethyl substituted polysiloxanes, and/or the like), auxiliary foam stabilizing surfactants (such as a fatty acid amide surfactant including $C_8$-$C_{20}$ alkanol amides, monoethanolamides, diethanolamides, isopropanolamides, and/or the like), dye transfer inhibitors (such as homopolymers and copolymers of vinyipyrrolidone and vinylimidazoie), soil release agents (such as a nonionic polyester of polypropylene terephthalate, a polyethylene glycol polyester, end-capped and non-end-capped sulfonated and unsulfonated PET/POET polymers, polyethylene glycol/polyvinyl alcohol graft copolymers, and/or anionic hydrophobic polysaccharides), antimicrobial agents (such as antimicrobials, germicides, and/or fungicides), and combinations thereof.

The method further includes the step of adding divalent cations to the mixture. In the embodiments described herein, the divalent cations are added subsequent to the combining step. Additionally, the divalent cations are added in the form of a salt. The divalent cations may be added by introducing the divalent cations into the mixture including at least the anionic surfactant(s), the fatty acid, and the water utilizing any suitable technique. Typically, the divalent cations are added to the mixture inside the batch mixer. The method further includes the step of combining the divalent cations with the mixture. This combining step may be accomplished by continuing the batch mixing process previously described.

As described above, the mixture formed during the combining step has a transparent optical appearance. Without being bound by any particular theory, it is believed that when the divalent cations are added subsequent to the combining step, the divalent cations interact with the fatty acid and the anionic surfactant to suitably opacify the mixture. Interaction between the divalent cations and the fatty acid and the anionic surfactant typically occurs immediately upon introducing the cations to the mixture, thereby causing an immediate opacification effect. Continued interaction between the divalent cations and the fatty acid and the anionic surfactant occurs upon combining the divalent cations with the components in the mixture such as by batch mixing mentioned above. Opacification increases or intensifies during the continued interaction between the divalent cations and the fatty acid and the anionic surfactant. Typically, a maximum opacification is reached after about 24 hours. Opacification advantageously occurs in the absence of a microplastic opacifier, rendering the opacified liquid detergent composition as entirely biodegradable. As used herein, the absence of a microplastic opacifier means that no microplastic opacifier is used or present in the composition.

In an embodiment, the divalent cations are calcium cations, and the adding step includes adding the calcium cations to the mixture. The calcium cations are derived from a substantially transparent material. As used herein, the term "substantially transparent material" refers to a material that allows light to pass through so that an object behind the material can be seen. The calcium cations, in combination with at least the fatty acid, in a particular weight ratio, form crystals suspended in the liquid components of the detergent composition and gives the composition an opacified appearance. The structuring effect occurs directly after the calcium cations are added and all of the components are blended together to form the liquid detergent composition. In an embodiment, and once the opacified liquid detergent composition is formed, the calcium cations and the fatty acid are present in the opacified liquid detergent composition in a weight ratio of from about 1:25 to about 1:150 of calcium cations to fatty acid. In another embodiment, the calcium cations and the fatty acid are present in the opacified liquid detergent composition in a weight ratio of from about 1:50 to about 1:125 of calcium cations to fatty acid. In yet another embodiment, the calcium cations and the fatty acid are present in the opacified liquid detergent composition in a weight ratio of from about 1:60 to about 1:10 of calcium cations to fatty acid.

The crystals formed from the combination of the calcium cations and at least the fatty acid also impart structure to the opacified liquid detergent composition, and these crystals may be referred to as a structurant. The presence of the structurant creates a yield point, which enables inclusion of additional materials (such as the colloidal materials) in the liquid detergent composition that would otherwise be unstable due, at least in part, to gravitational separation. A suitable yield point also maintains a substantially even distribution of the opacity of the liquid detergent composition and maintains suspension of the crystals in the liquid components of the liquid detergent composition. Without a suitable yield point, an uneven distribution of opacification may be evident, with parts of the composition being transparent and other parts of the composition being opacified.

The calcium cations are derived from a calcium salt chosen from calcium chloride, calcium carbonate, calcium citrate, calcium lactate, calcium gluconate, calcium sulfite, calcium bisulfate, calcium sulfate, and combinations thereof. In an embodiment, the calcium cations are derived from calcium chloride. In an embodiment, the method includes the step of dissolving the calcium salt in a solvent to form a solution prior to adding the calcium cations to the mixture formed during the combining step. In a non-limiting example, the calcium salt is dissolved in water to form a 30% salt solution, and the salt solution is added to the mixture during the adding step.

In another embodiment, the divalent cations are calcium cations and magnesium cations, and the adding step includes adding the calcium cations and the magnesium cations to the mixture. At least one of the calcium cations and the magnesium cations is derived from a substantially transparent material. In an embodiment, both of the calcium cations and the magnesium cations are derived from a substantially transparent material. As mentioned above, the divalent cations, in combination with at least the fatty acid, in a particular weight ratio, form crystals suspended in the liquid components of the detergent composition and gives the composition an opacified appearance. In this embodiment, the structuring effect occurs directly after the calcium and magnesium cations are added and all of the components are combined or blended together to form the liquid detergent composition. Once the opacified liquid detergent composition is made, the fatty acid, the magnesium cations, and the calcium cations are present in the opacified liquid detergent composition in a weight ratio of from about 0.95:0.04:0.01 to about 0.88:0.11:0.01 of fatty acid to magnesium cations to calcium cations. In another embodiment, the fatty acid, the magnesium cations, and the calcium cations are present in the opacified liquid detergent composition in a weight ratio of from about 0.97:0.03:0.01 to about 0.78:0.20:0.02 of fatty acid to magnesium cations to calcium cations. Additionally, the calcium cations and the magnesium cations are present in the opacified liquid detergent composition a weight ratio of from about 1:1 to about 1:20 of calcium cations to magnesium cations. In another embodiment, the calcium and magnesium cations are present in the opacified liquid detergent composition in a weight ratio of from about 1:1 to about 1:12 of calcium cations to magnesium cations.

The magnesium cations are derived from a magnesium salt chosen from magnesium chloride, magnesium chloride hexahydrate, magnesium citrate, magnesium sulfite, magnesium bisulfite, magnesium sulfate, and combinations thereof. In an embodiment, the magnesium cations are derived from magnesium chloride hexahydrate. The calcium cations are derived from a calcium salt chosen from calcium chloride, calcium carbonate, calcium citrate, calcium lactate, calcium gluconate, calcium sulfite, calcium bisulfite, calcium sulfate, and combinations thereof. In an embodiment, the calcium cations are derived from calcium chloride.

In an embodiment, the calcium cations and the magnesium cations may be dissolved in a solvent, such as water, to form a salt solution, and then the salt solution (containing the calcium and magnesium cations) are added to the mixture formed during the combining step. In an alternative embodiment, the calcium salt could be dissolved in a solvent to form a calcium salt solution and the magnesium salt could be dissolved in a solvent to form a magnesium salt solution, and the two salt solutions may be added to the mixture sequentially or substantially simultaneously.

The opacified liquid detergent composition formed or made by the method of the present disclosure includes at least one anionic surfactant, a fatty acid, divalent cations, and water. In one embodiment, the opacified liquid detergent composition includes the anionic surfactant(s), the fatty acid, calcium cations, and the water, where the calcium cations and the fatty acid are present in a weight ratio of from about 1:25 to about 1:150. The calcium cations are present in an amount of from about 0.01 to about 0.075% by weight, or from about 0.2 to about 0.07% by weight based on a total weight of said opacified liquid detergent composition. The fatty acid is present in an amount of at least about 1.25% by weight, or from about 1.75 to about 3% by weight based on a total weight of the opacified liquid detergent composition. The anionic surfactant(s) is present in an amount of from about 1 to about 20% by weight, or from about 1 to about 10% by weight based on a total weight of the opacified liquid detergent composition. The water is present in an amount of from about 30 to about 90% by weight based on a total weight of the opacified liquid detergent composition.

In another embodiment, the opacified liquid detergent composition includes the anionic surfactant(s), the fatty acid, calcium cations, magnesium cations, and the water, where the fatty acid, the magnesium cations, and the calcium cations are present in the opacified liquid detergent composition in a ratio of from about 0.95:0.04:0.01 to about 0.88:0.11:0.01 of fatty acid to magnesium cations to calcium cations. The magnesium cations are present in an amount of from about 0.05 to about 0.75% by weight, or from about 0.11 to about 0.30% by weight based on a total weight of said opacified liquid detergent composition. The calcium cations are present in an amount of from about 0.01 to about 0.075% by weight, or from about 0.02 to about 0.07% by weight based on a total weight of said opacified liquid detergent composition. The fatty acid is present in an amount of at least about 1.25% by weight, or from about 1.75 to about 3% by weight based on a total weight of the opacified liquid detergent composition. The anionic surfactant(s) is present in an amount of from about 1 to about 20% by weight, or from about 1 to about 10% by weight based on a total weight of the opacified liquid detergent composition. The water is present in an amount of from about 30 to about 90% by weight based on a total weight of the opacified liquid detergent composition.

The following examples are meant to illustrate the instant disclosure and are not to be viewed in any way as limiting the scope of the present claims.

EXAMPLES

Six samples of a liquid detergent composition were prepared. Two of the samples (Samples 1 and 4) were prepared including a magnesium chloride solution as a source of magnesium cations. Two of the samples (Samples 2 and 5) were prepared including a calcium chloride solution as a source of calcium cations. Two of the samples (Samples 3 and 6) were prepared including a magnesium chloride solution and a calcium chloride solution as sources for magnesium cations and calcium cations, respectively. Additionally, different ratios of surfactants were used in Samples 1-3 compared to Samples 4-6. The compositions of Samples 1-6 are set forth in Table 1 below.

TABLE 1

| Liquid Detergent Composition | | | | | | |
|---|---|---|---|---|---|---|
| Component | Sample 1 (wt %) | Sample 2 (wt %) | Sample 3 (wt %) | Sample 4 (wt %) | Sample 5 (wt %) | Sample 6 (wt %) |
| Non-Aqueous Solvent | 20.626 | 20.626 | 19.876 | 20.559 | 21.689 | 20.359 |
| 25-7 Nonionic Surfactant | 23.074 | 23.074 | 23.074 | 22.185 | 22.185 | 22.185 |
| Neutralizing Agent | 3.150 | 3.150 | 3.150 | 6.600 | 6.600 | 6.600 |
| Anionic Surfactant | 31.000 | 31.000 | 31.000 | 22.203 | 22.203 | 22.203 |
| Fatty Acid | 10.000 | 10.000 | 10.000 | 10.000 | 10.000 | 10.000 |
| Optical Brightener | 0.200 | 0.200 | 0.200 | 0.200 | 0.200 | 0.200 |
| Polymer (80% active) | 6.000 | 6.000 | 6.000 | 6.000 | 6.000 | 6.000 |
| Bittering Agent (25% active) | 0.050 | 0.050 | 0.050 | 0.050 | 0.050 | 0.050 |
| Deionized Water | 4.567 | 4.567 | 4.567 | 10.873 | 10.873 | 10.873 |
| $MgCl_2*6H_2O$ solution (30%) | 1.330 | 0 | 1.330 | 1.330 | 0 | 1.330 |
| $CaCl_2$ solution (20%) | 0 | 0.750 | 0.750 | 0 | 0.200 | 0.200 |
| Total | 100 | 100 | 100 | 100 | 100 | 100 |

In a first test, each of the liquid detergent compositions (Samples 1-6) were formulated or made by combining the nonionic surfactant, neutralizing agent, sulfate, optical brightener, polymer, bittering agent, solvents, and divalent cations (magnesium cations and/or calcium cations) to form a mixture, and then adding the anionic surfactant and the fatty acid to the mixture to form the liquid detergent compositions. A few hours after the compositions were formulated, a precipitate formed in each composition as observed by visual inspection. The presence of the precipitate is an indicator of instability of the compositions.

In a second test, the six liquid detergent compositions (Samples 1-6) were formulated by combining the nonionic surfactant, neutralizing agent, sulfate, optical brightener, polymer, bittering agent, solvents, the anionic surfactant, and the fatty acid to form a mixture, and then adding the divalent cations (magnesium cations and/or calcium cations) to form the liquid detergent compositions. In this test, no precipitate formed in any of the compositions as observed by visual inspection. The absence of the precipitate is an indicator of stability of the compositions.

As used herein, the article "a," "an," and "the" can be used herein to refer to one or more than one (i.e., to at least one) of the grammatical object of the article unless the language and/or context clearly indicates otherwise.

As used herein, the term "about" is understood by persons of ordinary skill in the art and varies to some extent depending upon the context in which the term is used. If there are uses of the term which are not clear to persons of ordinary skill in the art, given the context in which the term is used, "about" means up to plus or minus 10% of the particular term.

It is to be understood that one or more values described above may vary by +/−5%, +/−10%, +/−15%, +/−20%, etc. so long as the variance remains within the scope of the present disclosure. It is also to be understood that the appended claims are not limited to express particular compounds, compositions, or methods described in the detailed description, which may vary between particular embodiments which fall within the scope of the appended claims.

It is also to be understood that any ranges or subranges relied upon in describing the various embodiments of the present disclosure independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present disclosure, and such ranges and subranges may be further delineated into relevant halves, thirds, quarters, fifths, and so on. Additionally, an individual number within a disclosed range may be relied upon and provides adequate support for specific embodiments within the scope of the appended claims. For example, a range "of from about 100 to about 200" includes various individual integers such as 101, 102, 103, etc., as well as individual numbers including a decimal point (or fraction) such as 100.1, 100.2, etc., which may be relied upon and provide adequate support for specific embodiments within the scope of the appended claims.

The invention has been described in an illustrative manner, and it is to be understood that the terminology which has been used is intended to be in the nature of words of description rather than of limitation. It is now apparent to those skilled in the art that many modifications and variations of the present invention are possible in light of the above teachings. It is, therefore, to be understood that the invention may be practiced otherwise than as specifically described.

What is claimed is:

1. A method of making an opacified liquid detergent composition, said method comprising the steps of:

A) combining at least one anionic surfactant, a fatty acid, and water to form a mixture having a transparent optical appearance;

B) dissolving a calcium and/or magnesium salt into a solvent to form a salt solution comprising calcium and/or magnesium divalent cations;

C) adding the salt solution comprising the calcium and/or magnesium divalent cations to mixture A; and opacifying the mixture as the calcium and/or magnesium divalent cations interact with the fatty acid and the anionic surfactant to form the opacified liquid detergent composition in the absence of a microplastic opacifier, the opacified liquid detergent composition having a turbidity value of greater than about 250 turbidity units (NTUs) measured utilizing a turbidity meter at about 24° C.; wherein:

1) the anionic surfactant is selected from the group consisting of linear alkylbenzene sulfonate, an alcohol ethoxy sulfate having a backbone including from 8 to 20 carbon atoms and ethoxylated with from about 1 to about 10 moles of ethylene oxide, and combinations thereof;
2) the calcium salt is selected from the group consisting of calcium chloride, calcium carbonate, calcium citrate, calcium lactate, calcium gluconate, calcium sulfite, calcium bisulfite, calcium sulfate, and combinations thereof, and the magnesium salt is selected from the group consisting of magnesium chloride, magnesium chloride hexahydrate, magnesium citrate, magnesium sulfite, magnesium bisulfite, magnesium sulfate, and combinations thereof; and
3) the fatty acid is obtained from palm kernel oil and has a backbone including from 12 to 20 carbon atoms.

2. The method as set forth in claim 1, wherein the divalent cations are calcium cations.

3. The method as set forth in claim 2, wherein the opacified liquid detergent composition includes the calcium cations and the fatty acid in a weight ratio of from about 1:25 to about 1:150 of the calcium cations to the fatty acid.

4. The method as set forth in claim 1, wherein the divalent cations are calcium cations and magnesium cations.

5. The method as set forth in claim 1, wherein the opacified liquid detergent composition includes the fatty acid, the magnesium cations, and the calcium cations present in a weight ratio of from about 0.95:0.04:0.01 to about 0.88:0.11:0.01 of fatty acid to magnesium cations to calcium cations.

6. The method as set forth in claim 4, wherein the calcium cations and the magnesium cations are added to the mixture in a weight ratio of from about 1:1 to about 1:12 of calcium cations to magnesium cations.

7. The method as set forth in claim 1, further comprising the step of adding colloidal particles to the mixture.

8. The method as set forth in claim 7, wherein the step of adding colloidal particles occurs simultaneously with the step of adding the at least one anionic surfactant, the fatty acid, and the water to form the mixture.

9. The method as set forth in claim 1, wherein the at least one anionic surfactant is the linear alkylbenzene sulfonate.

10. The method as set forth in claim 1, further comprising the step of adding at least one nonionic surfactant to the mixture.

11. The method as set forth in claim 10, wherein the step of adding the at least one nonionic surfactant occurs simultaneously with the step of adding the at least one anionic surfactant, the fatty acid, and the water to form the mixture.

12. The method as set forth in claim 1, wherein the at least one anionic surfactant is the alkyl ethoxy sulfate.

13. The method as set forth in claim 1, wherein the combining step is performed by batch mixing.

14. The method as set forth in claim 1, wherein the divalent cations are magnesium cations.

* * * * *